US005484111A

United States Patent [19]

Dorscht et al.

[11] Patent Number: 5,484,111

[45] Date of Patent: Jan. 16, 1996

[54] HAMMERS FOR HAMMER MILLS

[75] Inventors: John P. Dorscht, Union; Patrick J. Hogan, Dorchester, both of Canada

[73] Assignee: Portec Inc., Oakbrook, Ill.

[21] Appl. No.: 251,174

[22] Filed: May 31, 1994

[51] Int. Cl.[6] ..... B02C 13/00

[52] U.S. Cl. ..... 241/197; 241/194

[58] Field of Search ..... 241/186.4, 189.1, 241/188.1, 194, 197, 195, 294, 300

[56] References Cited

U.S. PATENT DOCUMENTS

| | | | |
|---|---|---|---|
| D. 13,820 | 10/1914 | Kinsey | 241/194 X |
| 1,033,506 | 7/1912 | Williams | 241/197 |
| 1,753,473 | 4/1930 | Polster | 241/195 X |
| 1,760,097 | 5/1930 | Williams | 241/195 X |
| 1,928,516 | 9/1933 | Buskirk | 241/197 |
| 2,240,404 | 4/1941 | King | 83/11 |
| 2,509,242 | 5/1950 | Miller et al. | 241/194 X |
| 2,531,732 | 11/1950 | Hoffman | 55/118 |
| 2,566,798 | 9/1951 | Hiller | 241/197 |
| 2,605,972 | 8/1952 | LeBlanc | 241/197 |
| 3,093,329 | 6/1963 | Bridgewater | 241/275 |
| 3,491,959 | 1/1970 | Jensen | 241/194 |
| 3,917,179 | 11/1975 | Graf | 241/194 |
| 4,117,985 | 10/1978 | Lazareck | 241/197 |
| 4,600,160 | 1/1986 | Mengel et al. | 241/282.2 |
| 4,717,083 | 1/1988 | Quast et al. | 241/197 |
| 5,181,663 | 1/1993 | Dorscht et al. | 241/81 |
| 5,377,919 | 1/1995 | Roger et al. | 241/197 X |
| 5,381,976 | 1/1995 | Chon et al. | 241/197 |

*Primary Examiner*—Timothy V. Eley
*Attorney, Agent, or Firm*—R. Craig Armstrong

[57] ABSTRACT

The hammers provide multiple impact points for debris, by providing impact points via tips at different radii from the axis of rotation of the hammer mill. The tips preferably are at substantially the same radius from the axis of rotation of the hammer about the hammer support shaft, so that efficiency is maintained even as the hammers lay back. The multiple impact points produce a more effective result, by partially sizing the debris on initial impact, before more precise final sizing in the grinding chamber. Angled surfaces on the hammer tips provide more effective shearing and tearing action than with conventional bar hammers. Wear patterns are such that grinding efficiency as the hammers wear down is maintained throughout the life of the replaceable tips. Preferably, the hammers weigh substantially more than conventional hammers, to provide a higher energy impact, and to reduce the tendency of the hammers to lay back.

14 Claims, 13 Drawing Sheets

HAMMERS FOR HAMMER MILLS

BACKGROUND OF THE INVENTION

1. Field of the Invention

This inventions relates to hammers for hammer mills. The hammers are especially intended for use in the hammer mills of tub grinders or tumble grinders.

U.S. Pat. No. 5,181,663 granted to the present inventors in 1993 provides an example of a tub or "tumble" grinder which includes a hammer mill. Such grinders have a receptacle with a stationary floor and a rotatable cylindrical wall. The axis of rotation of the receptacle may be vertical (as is conventional), or preferably angled as described and illustrated in the patent. The hammer mill is positioned under the floor of the receptacle, and the hammers extend partially through an aperture in the floor. As the receptacle rotates with the hammer mill in operation, the hammers pull debris from the receptacle through the aperture into a grinding chamber. The debris is fragmented and sized in passing through the grinding chamber, and is then discharged. Ideally, the fragments are relatively uniform in size, although this is difficult to achieve in practice.

2. Description of the Prior Art

Grinders such as the one described in the above-mentioned patent, and others in the prior art, conventionally have a series of pivotable bar hammers, i.e. rectangular bars which are pivotally mounted on the mill. These bar hammers have a relatively small mass, typically about 28 pounds for example, and provide essentially a single impact, so they tend not to break up the debris very much on initial impact. Most of the reduction or "sizing" of the debris takes place in passing through the grinding chamber. Because of their relatively small mass, these hammers also tend to pivot or "lay back" on impact with the debris, instead of maintaining an orientation directly facing the debris. This significantly reduces the efficiency and effectiveness of the hammers, since they then only strike a glancing blow, and also results in less consistent sizing of the processed debris, since the tip clearance within the mill is increased as the hammers lay back.

Conventional bar hammers also become less efficient and effective as they wear, since the initially-square edges become rounded. This reduced effectiveness also increases the tendency of the hammers to lay back, thus further reducing efficiency. The hammers must therefore be replaced more frequently than is desirable, in order to maintain optimum efficiency and effectiveness.

SUMMARY OF THE INVENTION

In the invention, fewer hammers are employed, these hammers are uniquely configured in order to provide optimum performance both initially and throughout their useful life.

Two primary embodiments are described herein, although many other variations are possible within the scope of the invention. In each embodiment, multiple impact points are provided by tips at different radii from the axis of rotation of the hammer mill, and the tips preferably are at substantially the same radius from the axis of rotation of the hammer about the hammer support shaft, so that efficiency is maintained even as the hammers lay back, as will be explained later herein. The multiple impact points produce a more effective result, by partially sizing the debris on initial impact, before more precise final sizing in the grinding chamber. Angled surfaces on the hammer tips provide more effective shearing and tearing action than with conventional bar hammers. Wear patterns are such that grinding efficiency as the hammers wear down is maintained throughout the life of the replaceable tips.

Preferably, but not essentially, the hammers weigh substantially more than conventional hammers, to provide a higher energy impact, and to reduce the tendency of the hammers to lay back.

Additional features of the invention will be described or will become apparent in the course of the following detailed description.

BRIEF DESCRIPTION OF THE DRAWINGS

The invention will now be described by detailing two preferred embodiments, as examples only, utilizing the accompanying drawings in which:

FIG. 13(*b*) is a cross-sectional side view corresponding to FIG. 13(*a*), after wear;

DETAILED DESCRIPTION OF THE PREFERRED EMBODIMENTS

Figure 1:
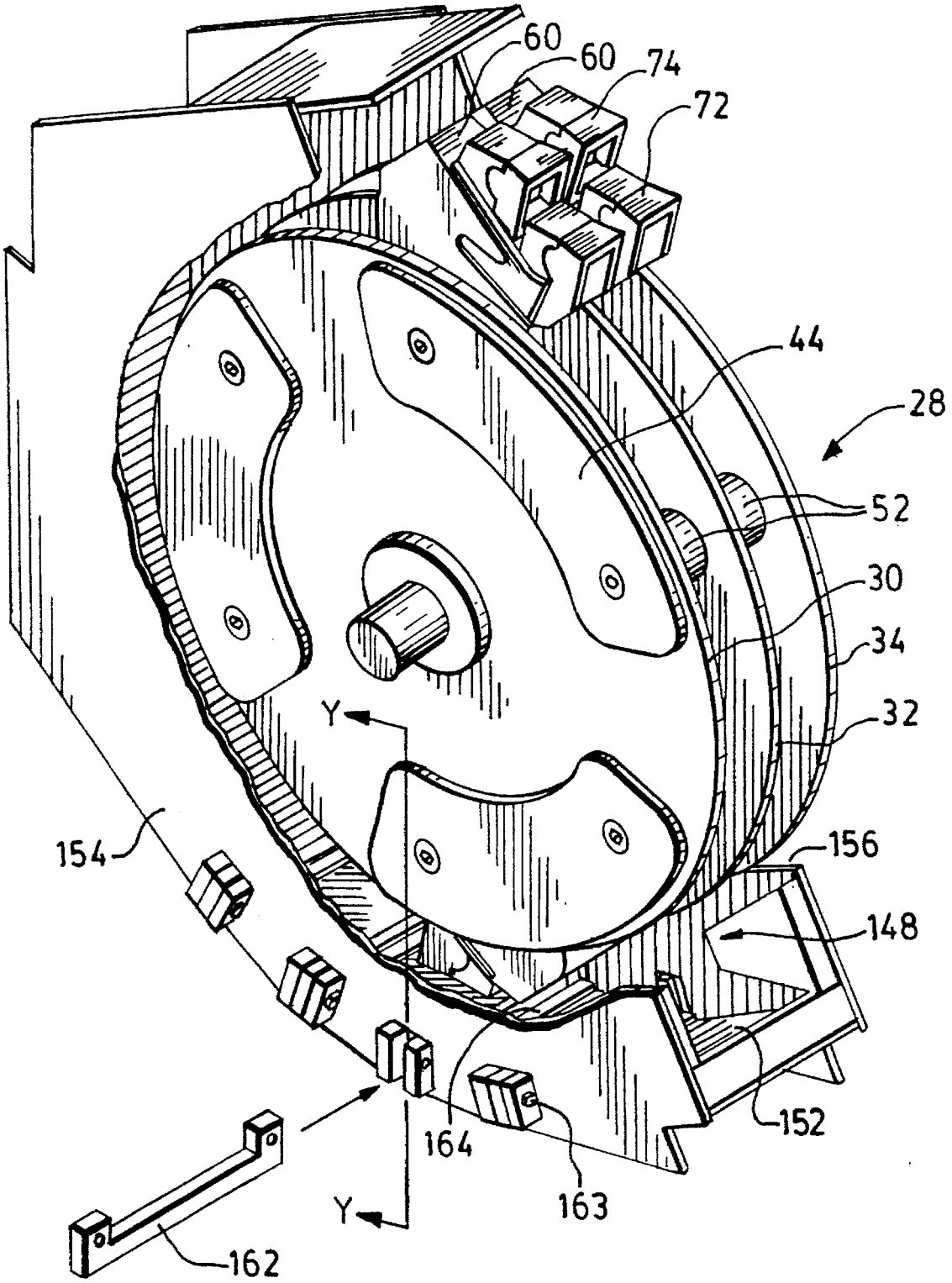
FIG. 1 is a perspective view of a hammer mill having two pairs of hammers of a first type.
Figure 2:
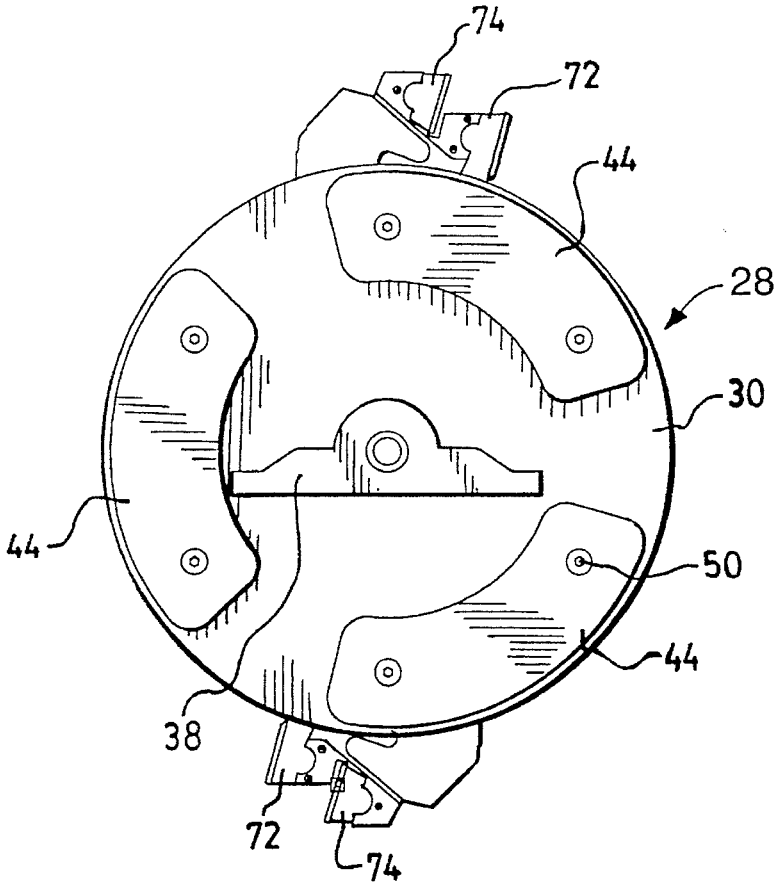
FIG. 2 is a side view of the rotor and hammers of the hammer mill.
Figure 3:
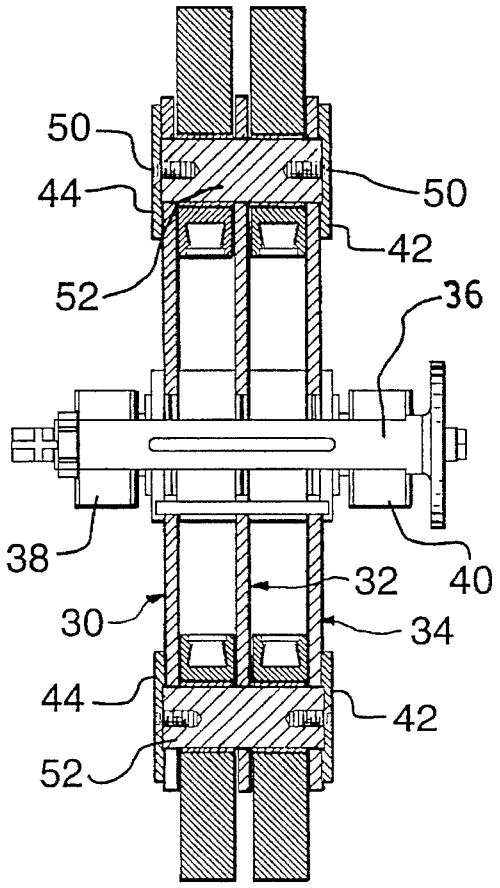
FIG. 3 is a sectioned end view of the hammer mill, the view illustrating the three circular disks of the hammer mill as well as the mounting of the hammers between adjacent pairs of disks.

With reference to FIGS. 1 to 3, a hammer mill generally designated 28 has three more or less circular steel disks 30, 32 and 34 extending in parallel, spaced relationship. A shaft 36, mounted on bearings 38 and 40 to the frame of a grinder (not shown), extends through the center of disks 30, 32 and 34. During the operation of the grinder, shaft 36 is rotated at approximately 1450 r.p.m. more or less, by a motor (not shown). A positive engagement between shaft 36 and disks 30, 32 and 34 results in those disks rotating together at that same angular speed.

The hammer mill 28 may be built to carry any desired number of hammers. Several examples are illustrated, namely the versions in FIGS. 1–4 or 18 and 19 having two pairs of hammers, and the version shown in FIG. 20 having four pairs of hammers. Each pair of hammers is mounted in tandem on the hammer mill, although it should be clear that a mill could be constructed with only a single hammer at each location, or with three or more hammers at each location, depending on the desired width of the mill.

Outside disk 30 has a series of reinforcement plates 44 fastened symmetrically to its outside surface adjacent the periphery, as shown in FIGS. 1–3. Outside disk 34 has a similar set of reinforcement plates 42 fastened to its outside surface. Each of the outside disks 30 and 34 of the first size of hammer mill, shown in FIGS. 1 to 3, has three reinforcement plates. Each of the outside disks of the larger size of hammer mill shown in FIG. 20 has four such plates, but that may vary depending on the number of hammer support shafts or hammers in the assembly.

As seen best in FIG. 3, hammer support shafts 52 extend through holes in the discs. Bolts 50 secure the reinforcement plates to the shafts 52. The first size of hammer mill has six hammer support shafts 52 (two carrying hammers), whereas the second size of hammer mill has eight such shafts (four carrying hammers). In each case, more or fewer support shafts could be used, according to design and preference. Of each tandem pair of hammers in the hammer mill, one hammer is mounted on a shaft 52 between disks 30 and 32, and the other hammer is mounted on that shaft between disks 32 and 34.

Figure 18:
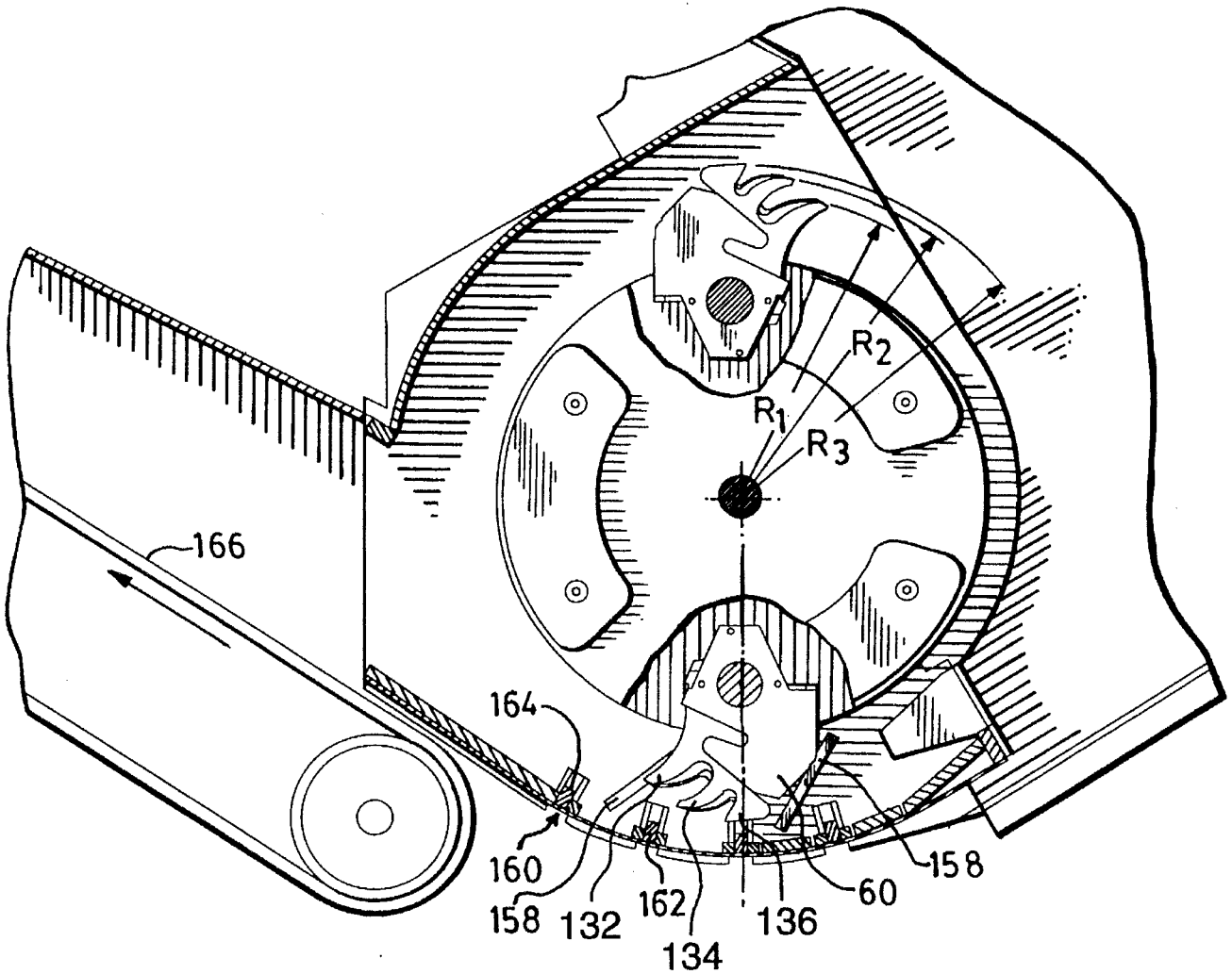
FIG. 18 is a view similar to FIG. 4, but illustrating hammers of a second type in their "normal" angular orientation.
Figure 19:
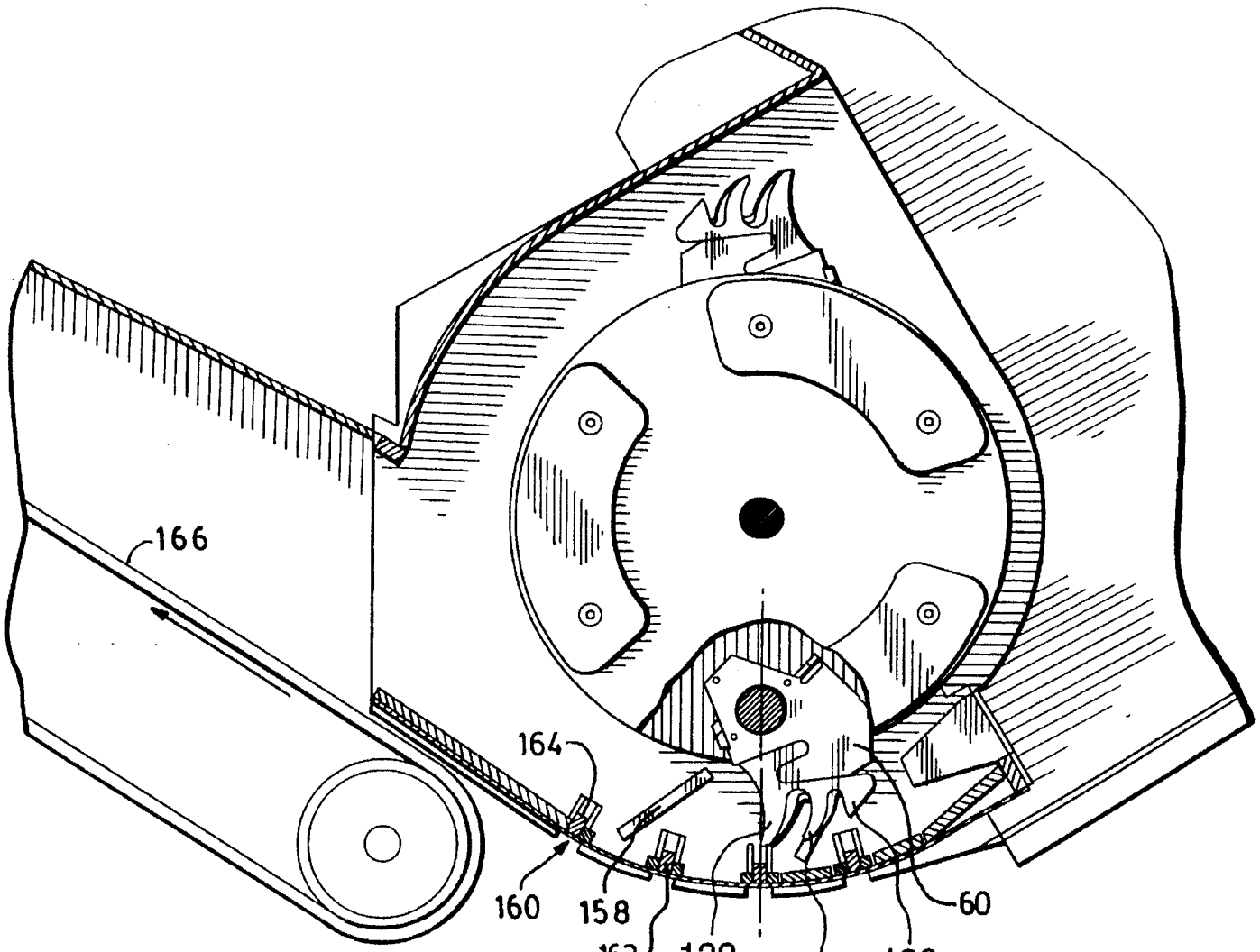
FIG. 19 is a view corresponding to FIG. 18, but illustrating the hammers partially pivoted or "laid back"
Figure 20:
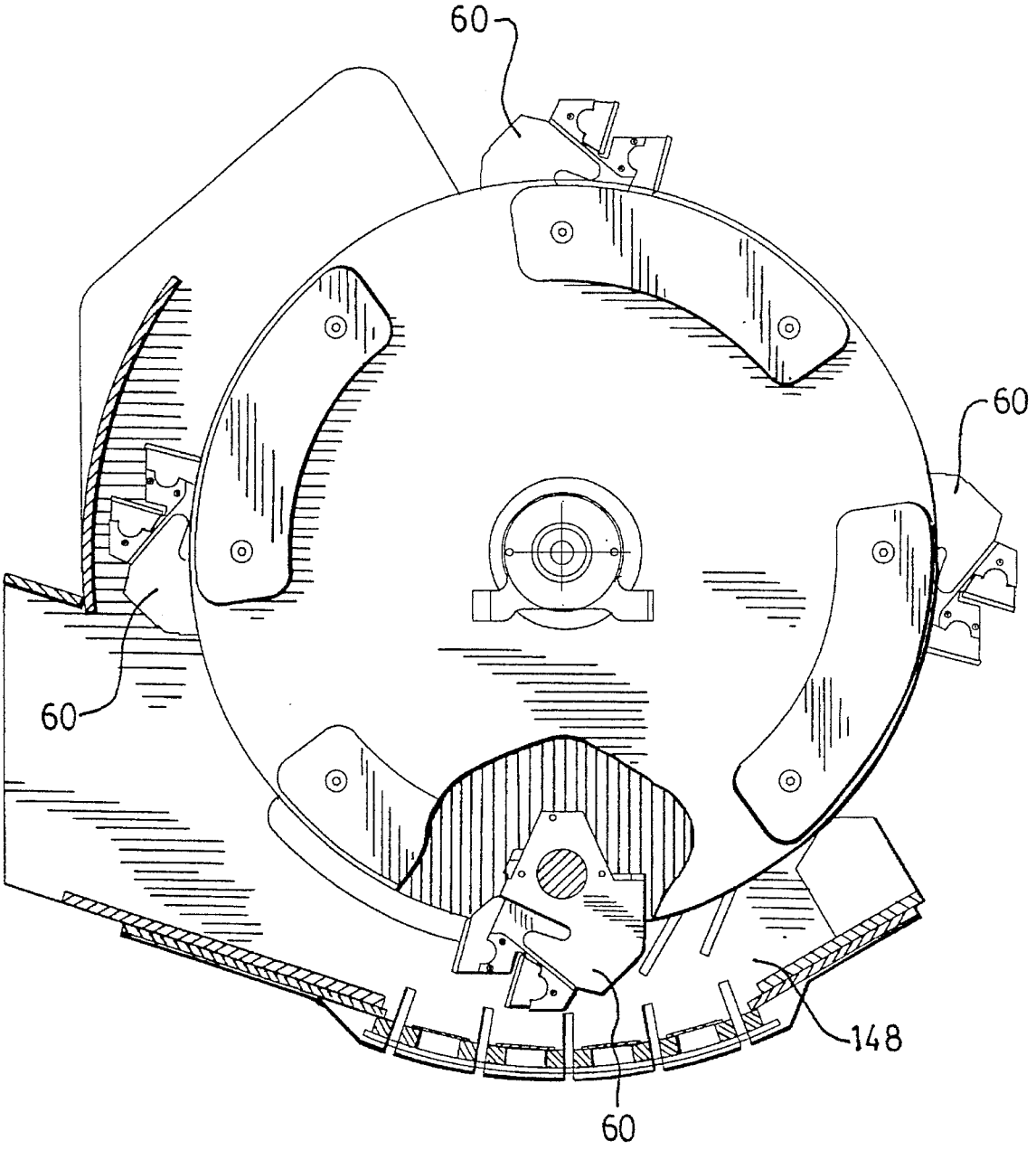
FIG. 20 is a partially-sectioned side view of a hammer mill having four pairs of hammers instead of two.

Two types of hammers are described as examples of the invention. The first type is shown in FIGS. 1–6 generally and FIGS. 7–14 in detail. The second type is shown in FIGS. 18 and 19 generally, and FIGS. 15–17 in detail. Both types preferably but not necessarily use the same shank member 60. Shank member 60 has a central bore 62, through which passes one of the hammer support shafts 52.

Although it is convenient from a manufacturing cost viewpoint to use the same shank for each type of hammer, it is not essential that the shanks be identical nor that there be a separate shank member at all. The hammers could be constructed with different shanks, or in one piece if desired, and with or without replaceable wear components. The invention is not intended to be limited to embodiments having a common shank, even though that may be preferable.

Figure 7:
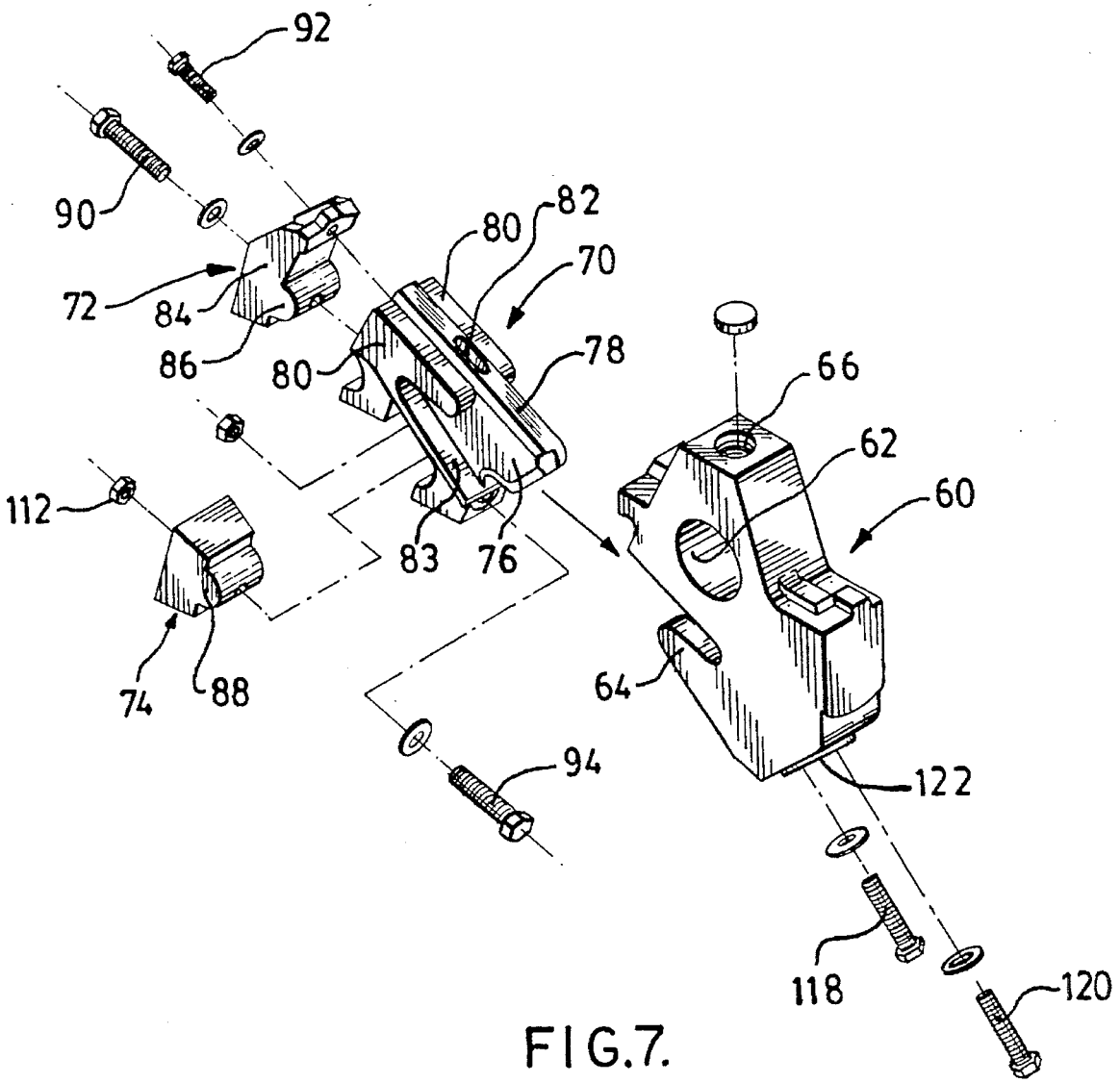
FIG. 7 is a perspective view of a disassembled hammer of the first type, the view illustrating a shank portion and a tip portion, the tip portion having a body and two replaceable tips.
Figure 8:
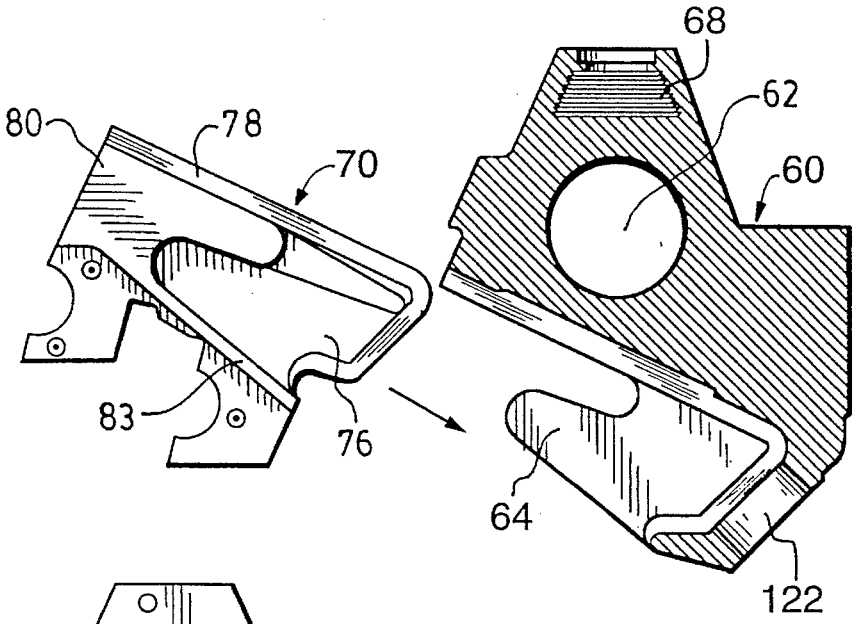
FIG. 8 is a partially-sectioned side view of the first type of hammer, disassembled.
Figure 9:
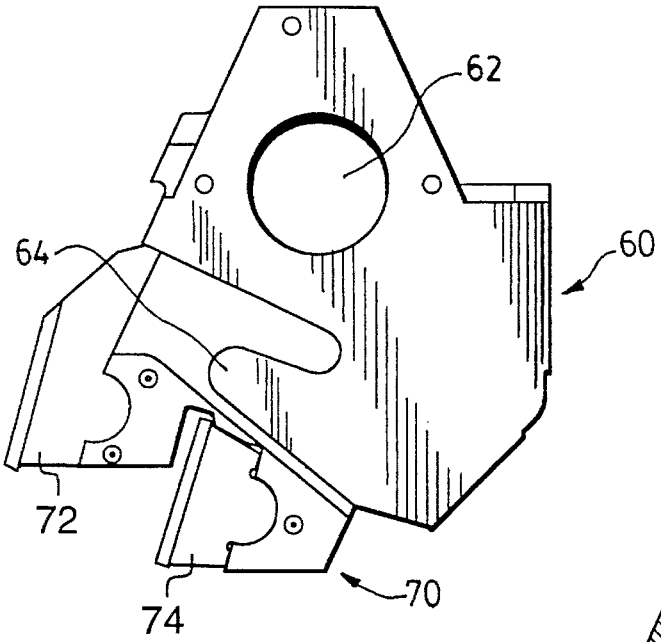
FIG. 9 is a side view of the first type of hammer, assembled.
Figure 10:
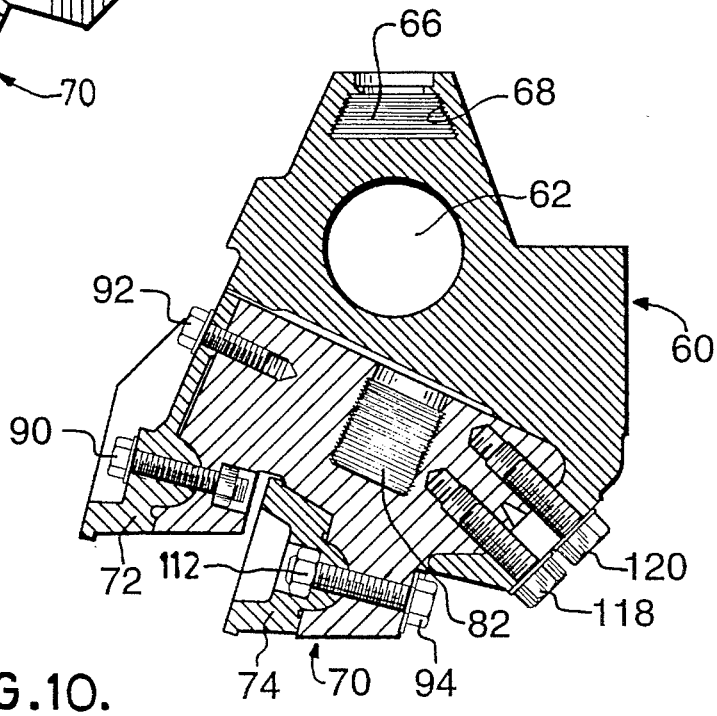
FIG. 10 is sectioned side view of the first type of hammer, assembled.

The shank, as seen best in FIGS. 7 and 8, has a tongue 64 for engaging the remaining portion of each hammer, as will be subsequently described. The side opposite the one side has a well 66 with corrugated walls 68 for accepting molten lead. This permits the weight of shank members to be maintained to within 1 gram of each other by using molten lead, that tolerance being important for maintaining optimum hammer mill balance.

Hammers in the present invention preferably weigh in the 100 to 150 pound range (typically about 125 pounds), in comparison with a prior art bar hammer weighing typically about 28 pounds. Lighter hammers embodying the features of the invention could be used, and are contemplated as being within the scope of the invention, although the results may not be as impressive. Approximately 80 percent of the mass of the hammer is outside the radius of the hammer support shaft, and the center of gravity of the overall hammer is on the center lines shown in FIGS. 5 and 18, with the hammers in their "normal" rotating position resulting from centrifugal force, i.e. where the hammer is not laid back from impact with debris.

The first type of hammer, as shown in detail in FIGS. 7–14, has a tip portion formed by a body member 70, a first tip 72 and a second tip 74. The first replaceable tip 72 is mountable on a front portion of body member 70, and the second replaceable tip 74 is mountable on body member 70 at a position to the rear of first tip 72. Body member 70 has a central flange 76, an upper rail 78 extending across the top of flange 76, and a pair of side supports 80 that extend from each side of flange 76 at the front of body member 70. Extending within upper rail 78 and central flange 76 is a well 82 for molten lead, to permit the weight of the body members to be maintained within 1 gram of each other at the time of shipment. An extension of the side supports 80 forms a lower rail 83 extending across the bottom of central flange 76.

First tip 72, which is adapted to be mounted at the front end of body member 70, has a width approximating the aggregate width of central flange 76 and the integral side supports 80. Second tip 74 has a width approximating the width of the lower rail 83 on central flange 76. The first tip 72 and the second tip 74 are of somilar design, except that first tip 72 has an extension 84 which extends to cover the front face of body member 70 when first tip 72 is mounted on member 70. The first tip 72 and second tip 74 each have a semicylindrical barrel portion, 86 and 88 respectively, which fits into a matching semicylindrical receptacle on body member 70 to prevent tip rotation. A pair of bolts, 90 and 92, is adapted to extend through first tip 72 to secure that tip to body member 70, while a single bolt 94 is adapted to be passed through lower rail 83 to hold second tip 74 on body member 70.

Figure 13A:
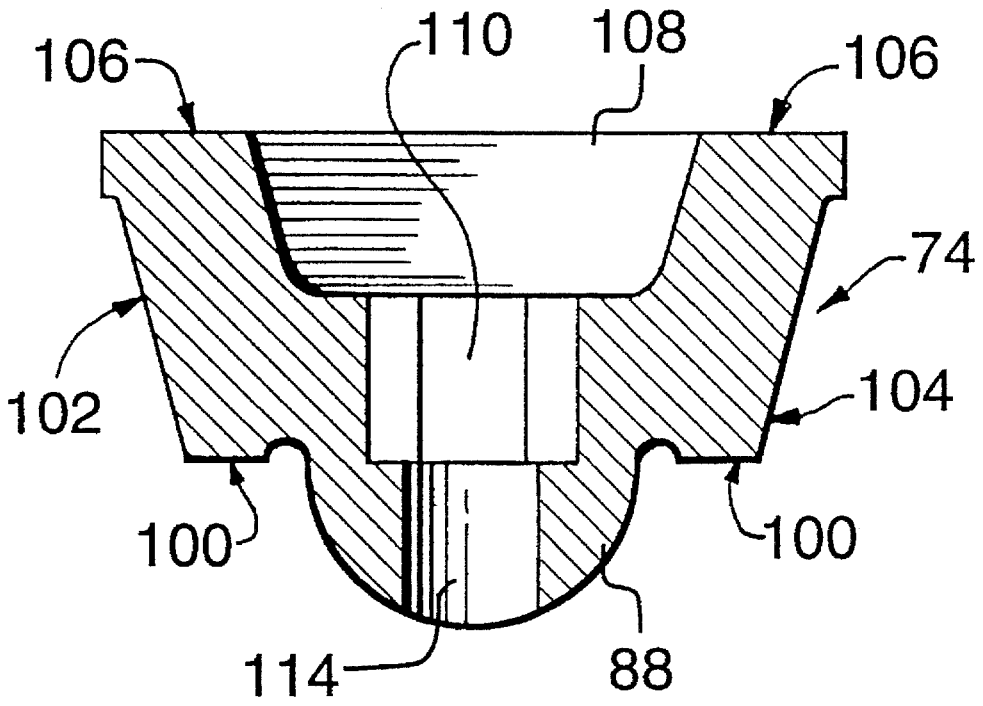
FIG. 13(*a*) is a cross-sectional side view of one of the tips on a hammer of the first type, before any wear.
Figure 13B:
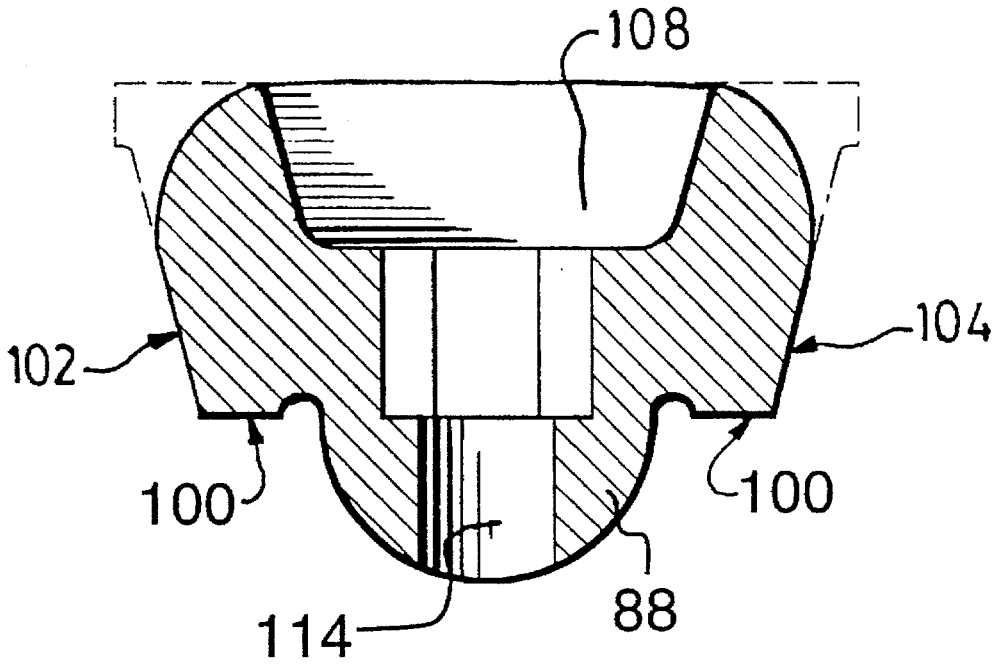

FIGS. 13(*a*) and 13(*b*) are cross-sectional views of one of the second tips 74. The tip 74 has a semicylindrical body portion 88 rising from a flat back surface 100, and a pair of sloped walls 102 and 104 extending between back surface 100 and a rectangular front surface 106. Tip 74 has a rectangular inner pocket generally designated 108, at the base of which sits a recess 110. The recess 110 has a profile matching the outer shape of a nut 112 adapted to fit onto the bolt 94 passing through a bore 114 in semicylindrical body portion 88. The replaceable tips 72 and 74 also each have a small cavity (not shown) for receiving molten lead; as shipped, all tips are within a narrow weight tolerance of approximate 1 gram.

Figure 11:
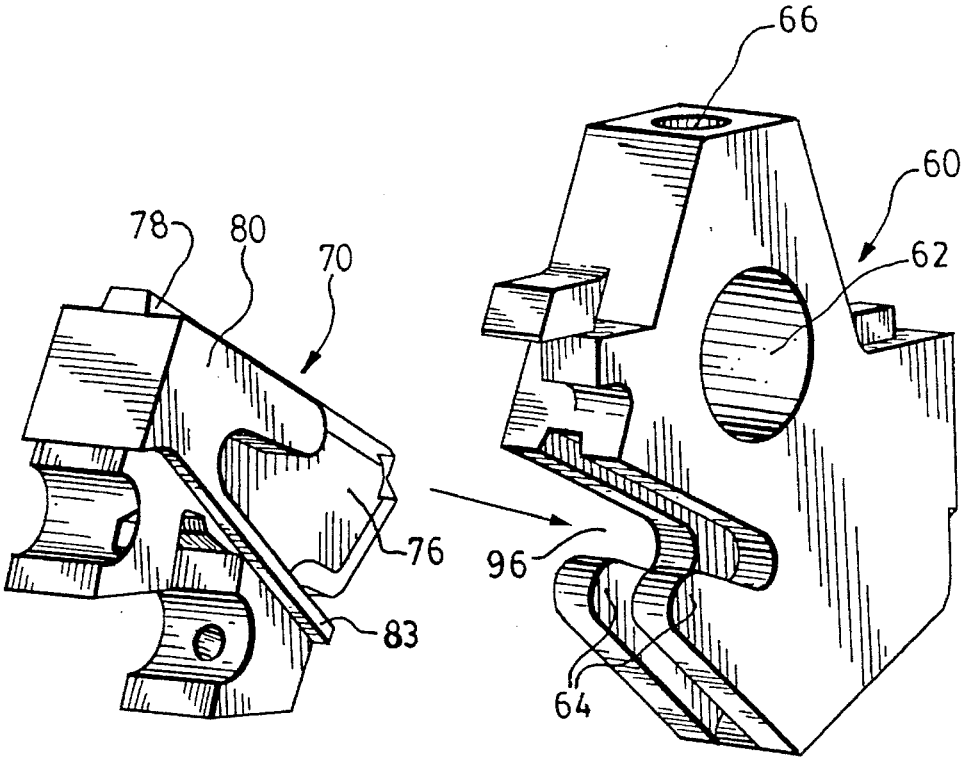
FIG. 11 is another perspective view of the first type of hammer, disassembled and without the replaceable tips.
Figure 12:
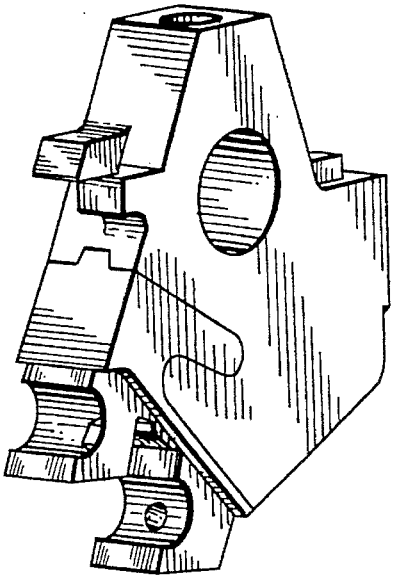
FIG. 12 is a perspective view corresponding to FIG. 11, assembled.

Referring to FIGS. 11 and 12, body member 70 fits into a recess 96 within shank member 60 shaped to receive central flange 76 and upper rail 78, such that side supports 80 abut against a pair of the tongues 64. A pair of bolts 118 and 120 (see FIGS. 7 and 10) fit through a slot 122 in the back end of shank member 60 into a pair of tapped receiving holes in body member 70.

As the replaceable tips wear, that wear creates a sharp edge on the boundary of inner pocket 108, as can be seen from comparing FIGS. 13(*a*) and 13(*b*). That sharp edge remains throughout the wear period of the end walls and side walls of the tip. This "self-sharpening" feature on the tips of the invention contrasts with conventional hammers, which have plain surfaces and edges which become rounded and less effective in use. The self-sharpening feature here maintains a high grinding rate throughout the life cycle of the replaceable tips. To further increase the effective life of the tips, it is an advantage of the invention that it is relatively easy to rotate the tips, with a minimum of maintenance down-time.

Figure 14:
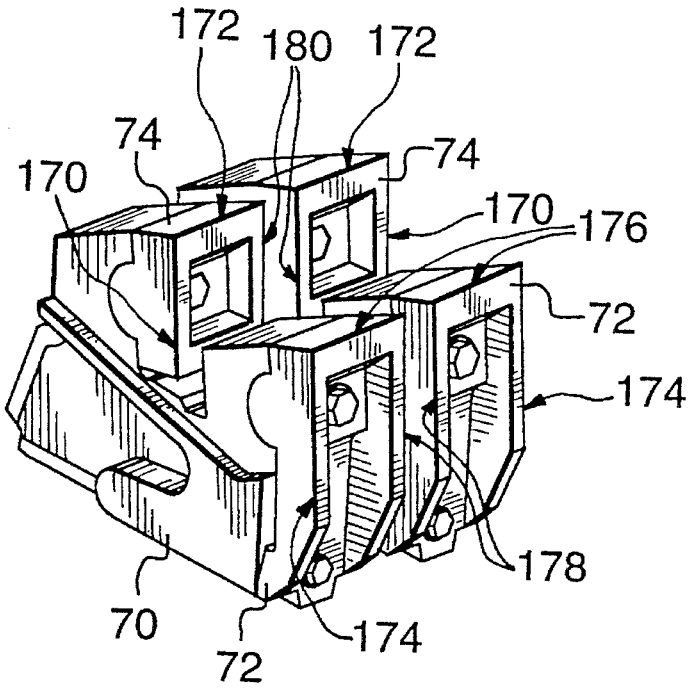
FIG. 14 is a perspective view of the tip portions of a tandem pair of hammers of the first type, with the replaceable tips.

FIG. 14 illustrates a pair of body members 70 extending in tandem, each body member having mounted on it a first tip 72 and a second tip 74. It has been found that the second tips 74 wear faster than the first tips 72, and that after an initial period of operation of the grinder the outer edges 170 and end edges 172 of the second tips 74 are more worn than the outer edges 174 and end edges 176 of the first tips 72. The inner edges of the first and second tips, 178 and 180 respectively, have significantly less wear than the outer edges, 174 and 170 respectively. Rotation of the tips can be used to even out this wear over time.

Figure 15:
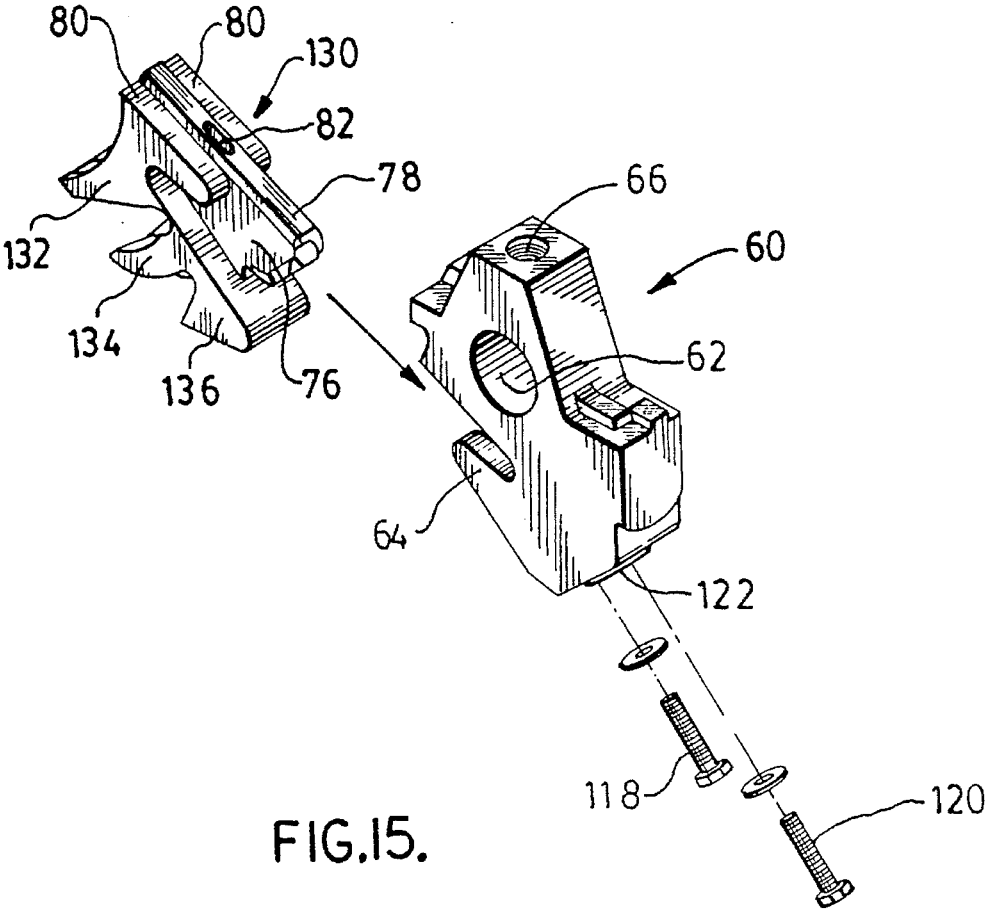
FIG. 15 is a perspective view of a second type of hammer, disassembled, the view illustrating a shank portion and a tip portion having three integral "claws" providing six tips.
Figure 16:
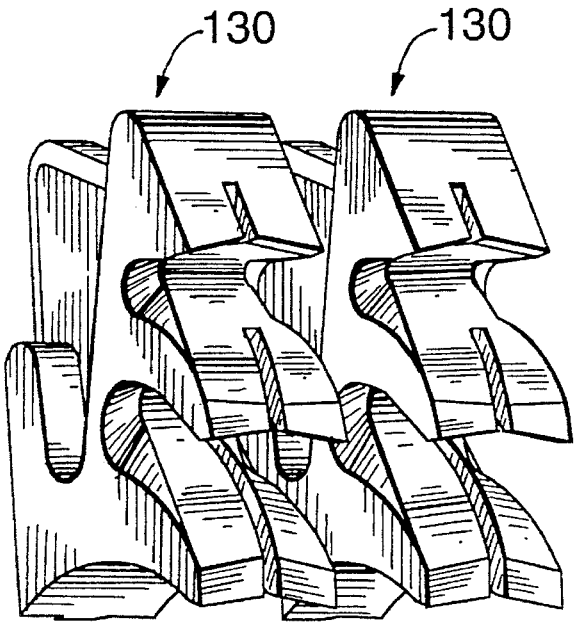
FIG. 16 is a perspective view of a tandem pair of hammers of the second type.
Figure 17:
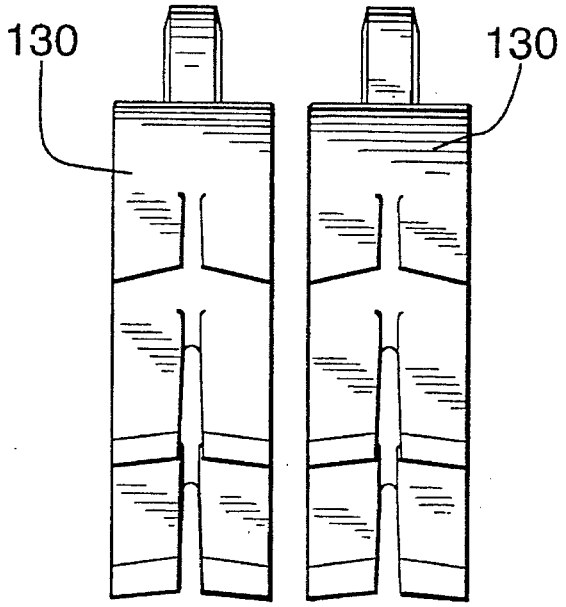
FIG. 17 is an end view corresponding to FIG. 16.

FIGS. 15–17 illustrate the second type of hammer. This type of hammer preferably uses the same shank member 60 as the first type of hammer, although as mentioned above, it could instead be produced as one piece. However, the tip portion 130 does not have replaceable tips as in the first type of hammer, but instead has three integral "claws", split in the middle to provide six integral tips. From front to back, those claws are designated 132, 134 and 136. The shape of the claws and tips is designed to rip into tree stumps and the like, the rake angle of approximately 15 degrees at the tips produced combined shearing and tearing action for greater efficiency. The tips of this type of hammer are configured to withstand heavier use than the tips of the first type, are capable of tearing through a broader range of materials, and are not as subject to breakage when encountering contamination such as rocks, steel, etc.

With this hammer design, wear is such that the claws and tips gradually shorten, but they wear back in such a way that they remain relatively sharp, as with the first type of hammer. As with the first type of hammer, this maintains a high grinding rate throughout the life cycle of the hammer.

Figure 4:
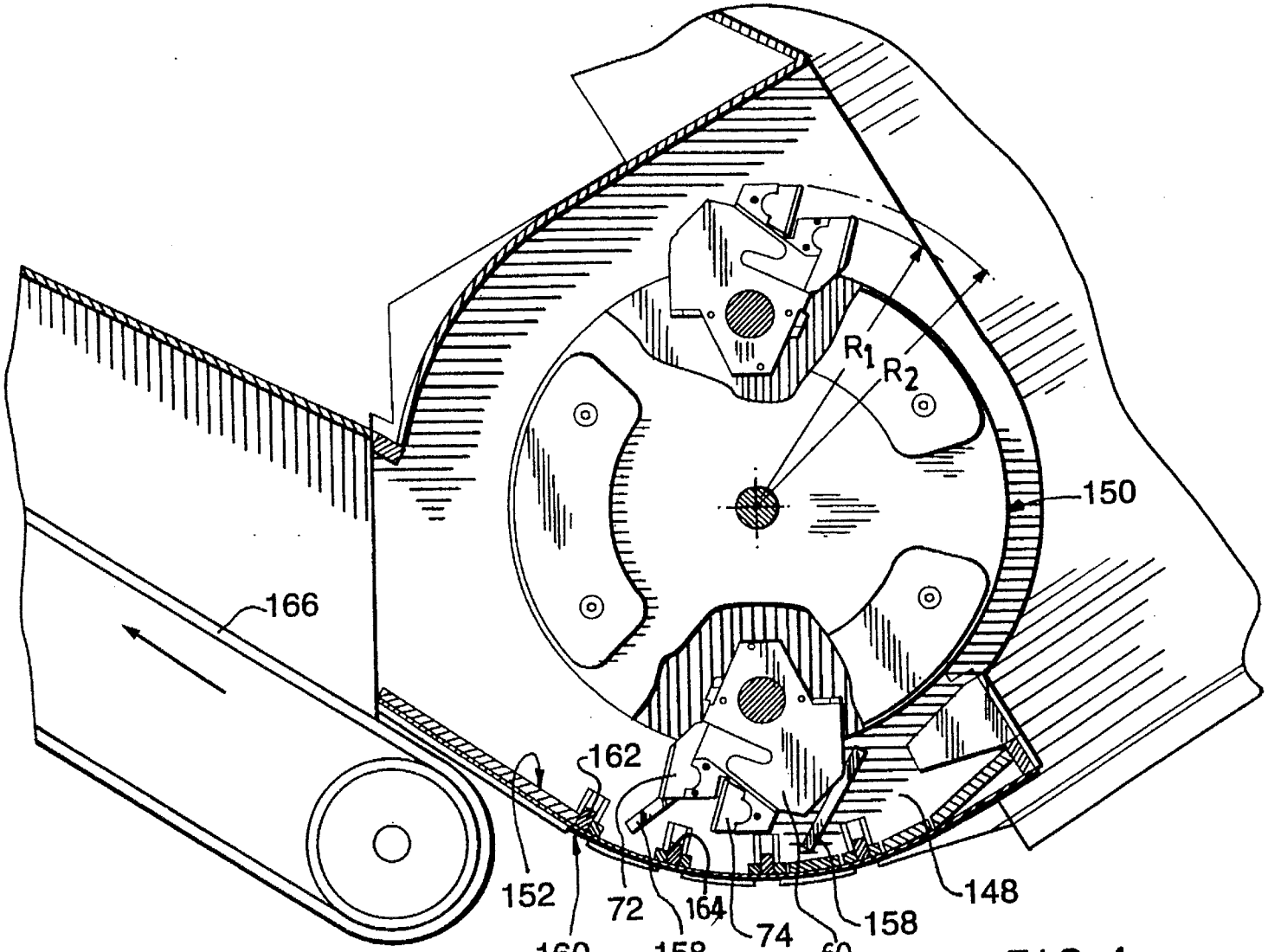
FIG. 4 is a partially-sectioned side view of the hammer mill.

Referring to FIG. 18 (see the radii $R_1$, $R_2$ and $R_3$ shown on the upper hammer), the six tips of the three claws 132, 134 and 136 of the second type of hammer normally extend such that when hammer mill 28 rotates at its normal operative speed of 1450 r.p.m. within an empty grinder, claw 136 is positioned radially outward of claw 134, which in turn is positioned radially outward of claw 132. FIG. 4 illustrates the corresponding situation with respect to the first type of hammer (see the radii $R_1$, and $R_2$), with tip 74 being positioned radially outward of tip 72. The effect of these configurations is that, in comparison to a single strike made on debris in the receptacle of a grinder by a conventional hammer, the hammers of the invention strike the debris at several impact points on each pass. The advantages of this are that fewer hammers are employed to make the same number of hits, and the debris in the receptacle is broken into smaller pieces on the initial impacts, providing a primary grind of the product so that the multiple smaller pieces are then more easily ground to finished size in the grinding chamber. By contrast, with the prior art single impact hammers, the debris is not sized to the same extent on the initial impact before entry to the grinding chamber.

Figure 5:
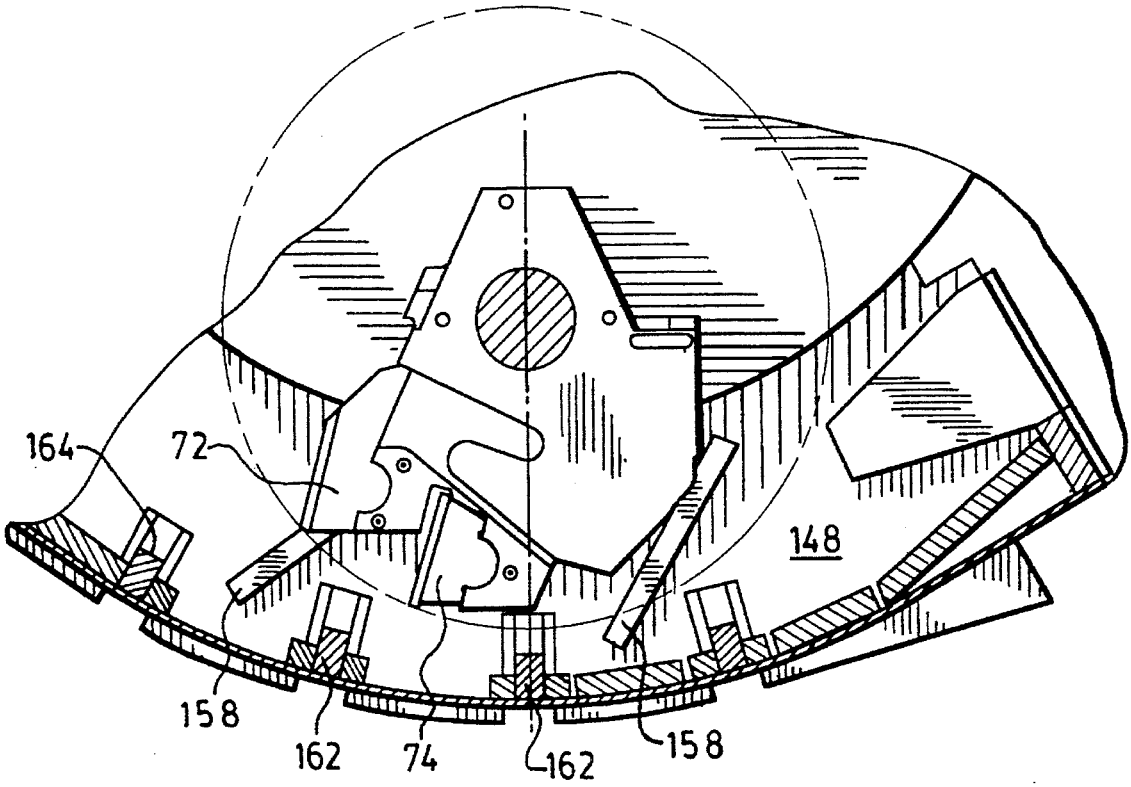
FIG. 5 is a side view of the first type of hammer in the "normal" angular orientation.
Figure 6:
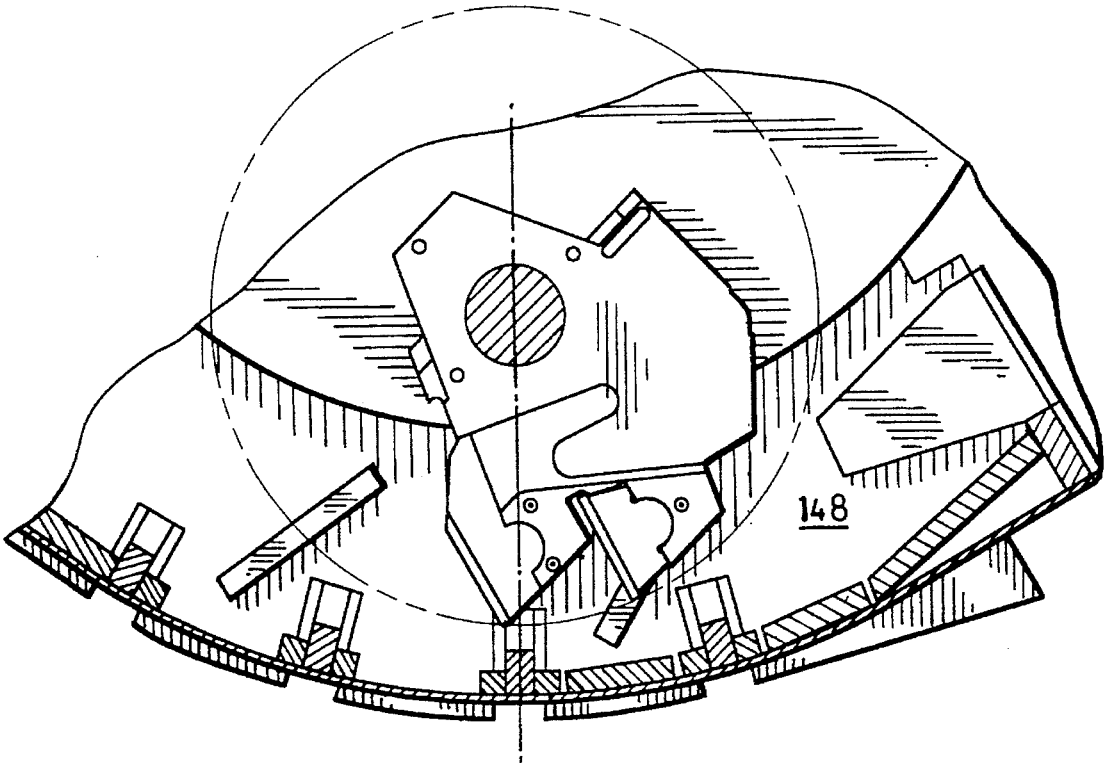
FIG. 6 is a side view corresponding to FIG. 5, but illustrating the hammer in the "laid back" position.

As debris in, the grinder provides opposition to the passage of the hammers, the hammers may rotate or "lay back" such that the difference between the radial distance of the tips from the center of the hammer mill is reduced, as shown in FIGS. 6 and 19 (compare against FIGS. 5 and 18 where the hammers are not laid back). In the laid-back configuration, conventional hammers operate at greatly reduced efficiency. However, in the preferred embodiments the hammers of the invention continue to be effective, since the forward-most tip on each hammer still impacts the debris at an effective angle and without an excessive gap between the tip and the striker plate. This is because the tips, although at different radii from the center of the mill (when in their "normal" position), preferably are at the same radius from the hammer support shafts 52. This can be seen clearly in FIGS. 5 and 6 for hammers of the first type, and the same is true for hammers of the second type. This provides an automatic compensation mechanism, with the size of the ground output being maintained, even if the hammers lay back by up to nearly 60 degrees.

Pieces of the debris in the receptacle of the grinder are drawn by the tips on each tandem pair of hammers into a grinding chamber 148 with a rectangular cross-section which extends between the circumferential surface 150 of the hammer mill, the facing arcuate surface 152 on the grinder frame, and a pair of side surfaces 154 and 156 on that frame (see FIGS. 1 and 4). A series of angled side struts 158 are mounted on each of the side surfaces 154 and 156, as illustrated in FIG. 5. Each strut 158 extends into the chamber 148 a distance such that its outer edge is only slightly spaced from the side supports 80 of a tip portion of a hammer moving past. Debris extending from the side of a tip on a hammer is ripped apart as the hammer moves past one of the struts 158. The arcuate surface 152 that faces the hammers has a series of slots 160 extending across it, each slot 160 extending normal to the path of hammer movement. Into each slot 160 is fitted a striker bar 162 of pre-cut height, that bar being retained in place by a pair of keepers 163. The striker bars 162 are sized such that there exists only a slight clearance between their radially-inward surface 164 and the radially-greatest path traced by the tip of a hammer moving past, for a small secondary ground product, or a larger clearance for a large secondary ground product. A conveyor belt 166 is positioned to remove debris discharged from the grinding chamber 148.

Many variations on the above embodiments will be apparent to those who are knowledgeable in the field of the invention, and such variations are intended to be within the scope of the accompanying claims, whether or not expressly described above.

The essence of the invention, as defined in the claims, resides not in the specific embodiments, but in the above-mentioned features (multiple impact points, multiple tip radii, self-sharpening, etc.) which produce the advantages of the invention.

We claim:

1. A hammer for the hammer mill of a tub or tumble grinder, said hammer mill having a rotor rotating about a mill axis, with a plurality of hammer support shafts mounted transversely adjacent the periphery of the rotor for carrying a plurality of said hammers, each said hammer having means for pivotal connection to one of said hammer support shafts for rotation about a hammer axis parallel to said mill axis, and each said hammer having a plurality of impact areas on a side thereof, each impact area having an impact tip projecting forwardly from the hammer in the direction of rotation of the rotor, at least two of said impact tips being positioned such that they are at different radial distances from the mill axis and substantially the same distance from the means for pivotal connection when the rotor is rotating with the hammer in a normal not laid-back position, thereby providing multiple impact points for debris and an outermost tip radius.

2. A hammer as recited in claim 1, where said impact tips project forwardly such that as they gradually wear from impact with debris, they continue to present relatively sharp leading edges, thereby maintaining efficiency.

3. A hammer as recited in claim 1, where said at least two impact tips are provided by at least two replaceable tips mounted on said hammer.

4. A hammer as recited in claim 3, where each said replaceable tip is generally rectangular and has a central recess defining a pocket with surrounding walls facing forwardly.

5. A hammer as recited in claim 4, where there are two said replaceable tips.

6. A hammer as recited in claim 1, where said at least two impact tips are provided by projections from a main body portion of said hammer, said projections tapering from said main body portion, to a pointed forward edge.

7. A hammer as recited in claim 6, where there are three said projections, each at different radii from the mill axis, each said projection having a central split, thereby providing two impact points on each projection and six impact points in total.

8. A hammer as recited in claim 1, wherein, substantially the same outermost tip radius from the rotor axis is maintained if the hammers lay back by virtue of impact with debris and resulting rotation about the hammer axis, thereby maintaining efficiency.

9. A hammer as recited in claim 8, where said impact tips project forwardly such that as they gradually wear from impact with debris, they continue to present relatively sharp leading edges, thereby maintaining efficiency.

10. A hammer as recited in claim 8, where said at least two impact tips are provided by at least two replaceable tips mounted on said hammer.

11. A hammer as recited in claim 10, where each said replaceable tip is generally rectangular and has a central recess defining a pocket with surrounding walls facing forwardly.

12. A hammer as recited in claim 11, where there are two said replaceable tips.

13. A hammer as recited in claim 8, where said at least two impact tips are provided by projections from a main body portion of said hammer, said projections tapering from said main body portion, to a pointed forward edge.

14. A hammer as recited in claim 13, where there are three said projections, each at different mill radii, each said projection having a central split, thereby providing two impact points on each projection and six impact points in total.

* * * * *